US005417444A

United States Patent [19]

Chen

[11] Patent Number: 5,417,444

[45] Date of Patent: May 23, 1995

[54] SKATEBOARD WITH MULTI-BOARDS

[75] Inventor: Ting-Hsing Chen, Kue-Jin Hsiang, Taiwan, Prov. of China

[73] Assignee: Far Great Plastics Industrial Co., Ltd., Tainan, Taiwan, Prov. of China

[21] Appl. No.: 265,118

[22] Filed: Jun. 24, 1994

[51] Int. Cl.[6] ..... A63C 17/02

[52] U.S. Cl. ..... 280/87.042; 280/7.15; 280/87.05

[58] Field of Search ..... 280/7.15, 7.1, 11.19, 280/809, 87.01, 87.021, 87.041, 87.042, 87.05

[56] References Cited

U.S. PATENT DOCUMENTS 2,253,012 8/1941 Benner et al. ..... 280/11.19 X
4,082,306 4/1978 Sheldon ..... 280/87.042 X
4,095,817 6/1978 Cohen ..... 280/87.042
4,458,907 7/1984 Meredith ..... 280/87.05 X
4,807,896 2/1989 Philippi ..... 280/87.042 X

*Primary Examiner*—Margaret A. Focarino
*Assistant Examiner*—Michael Mar
*Attorney, Agent, or Firm*—Morton J. Rosenberg; David I. Klein

[57] ABSTRACT

A skateboard of the present invention includes at least three board members each of which comprises of a plurality of elongated trough being formed integrally to the underside thereof and a pair of elongated rods which is bent twice and forming three phases adapted to receive the boards to form a skateboard having three planes. The elongated rods have conjunction areas at center portions. Upon the conjunction area is secured one of the three boards. When the conjunction area is detached, two separate skateboards are formed.

1 Claim, 4 Drawing Sheets

SKATEBOARD WITH MULTI-BOARDS

FIELD OF THE INVENTION

This invention relates to a skateboard with multi-boards, and more particularly to a skateboard having its structure detachable to form two separate skateboards.

BACKGROUND OF PRIOR ART

The first generation of a skateboard is to mount wheels directly on a board so that skater may stand on top of the board and to skate on a flat and smooth surface. This design was attracted by skaters for a period of time. But later skaters were seeking for a skateboard which is capable of performing more figure skates, and therefore, a skateboard having three boards mounted on a pair of elongated rods were invented and manufactured. However, this skateboard has a larger size that requires larger space to store and also inconvenient in carrying.

SUMMARY OF THE INVENTION

It is the primary object of the present invention to provide a skateboard which includes boards mounted on a pair of detachable, elongated rods, and which is capable of separating into two skateboards.

It is another object of the present invention to provide a skateboard which is easy to store and to carry.

It is a further object of the present invention to provide a skateboard which is inexpensive to manufacture.

DETAILED DESCRIPTION OF THE PREFERRED EMBODIMENT

Figure 1:
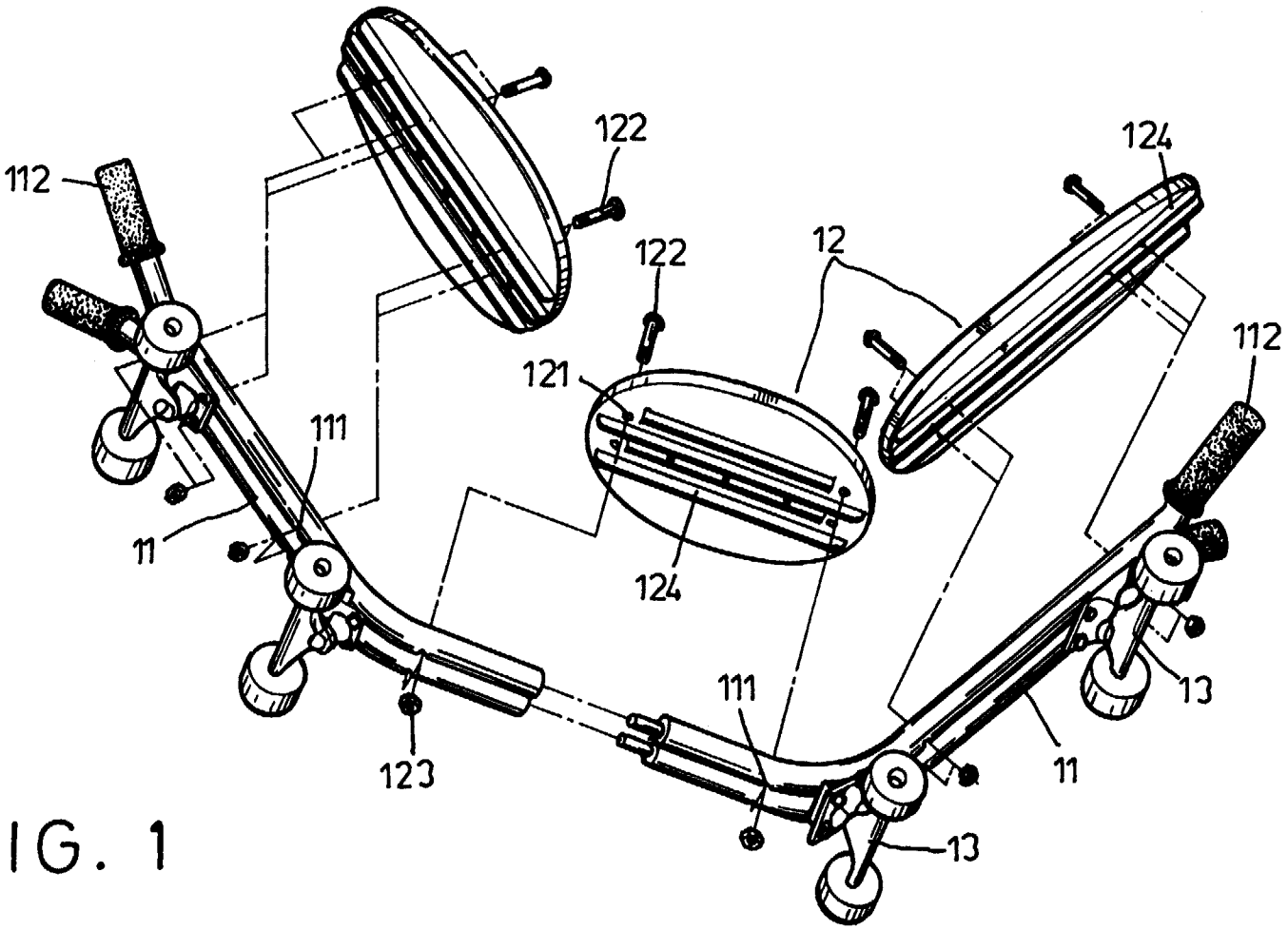
FIG. 1 is a fragmentary view of the present invention.

Reference is now made to the drawings wherein each showing is for the purpose of illustrating the present invention only and not for the purpose of limiting the present inventive concept. FIG. 1 shows the skateboard 1 of the present invention as being composed of three boards 12, a pair of elongated rods 11 being secured to the underside of the boards 1, respectively, and wheels 13 to the underside of the elongated rods.

Figure 2:
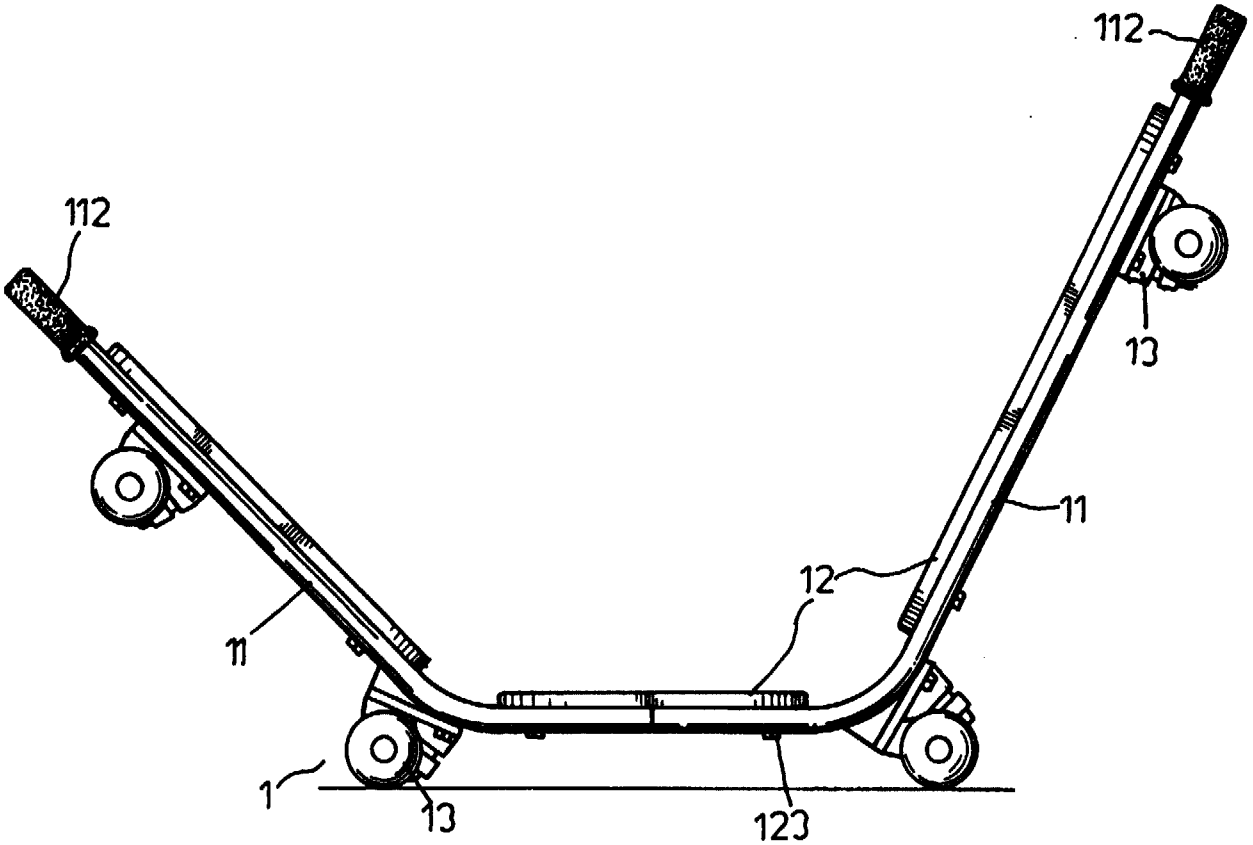
FIG. 2 is a perspective view of FIG. 1.
Figure 3A:
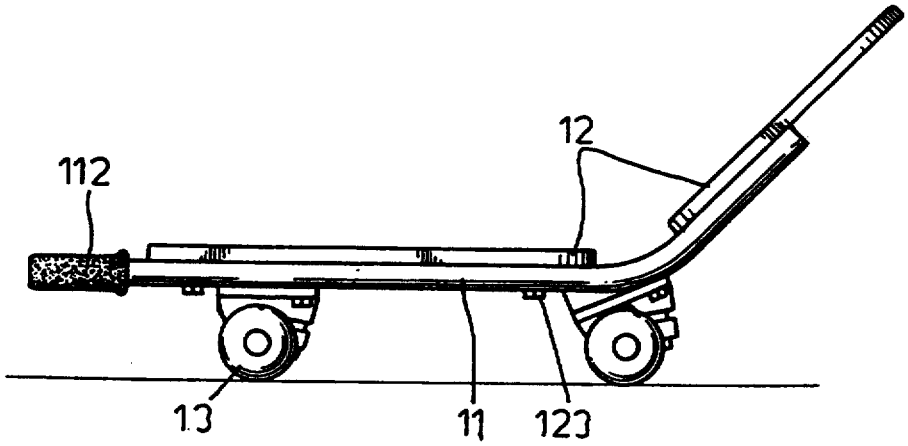
FIG. 3A is a side view of a second embodiment of the present invention.
Figure 3B:
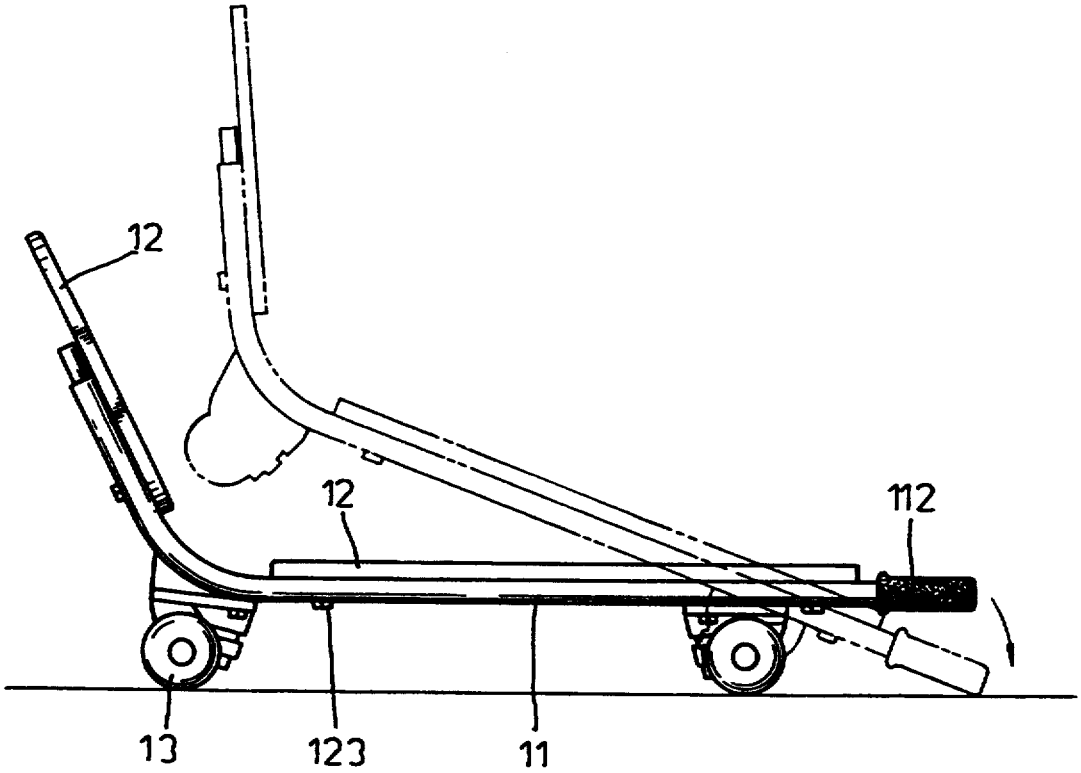
FIG. 3B is a third embodiment of the present invention.
Figure 4:
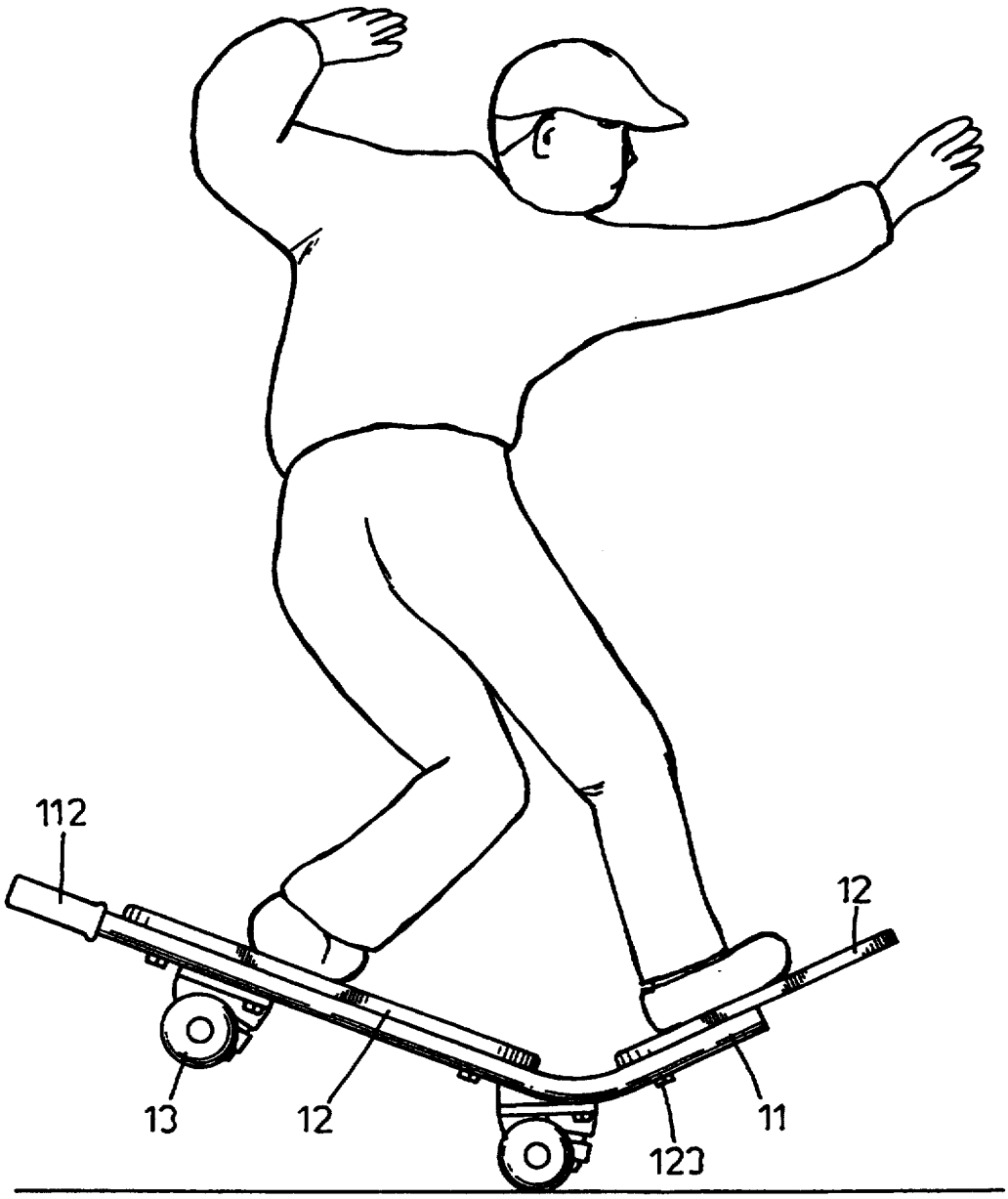
FIG. 4 is a side view of FIG. 3A having a skater riding on the board.

Each board 12 includes a pair of elongated troughs 124 at one side adapted to receive the rods 11 therein. A plurality of apertures 121 are formed on the board 12 adapted to receive countersunk bolts 122 therethrough which are securely mounted to the rods 11. As shown in FIG. 1, the pair of elongated rods 11 are formed as two frame sections, each frame section being bent at an obtuse angle to form inner and middle portions and diverging along an outer portion to form handgrips 112. The boards include two outer boards, each adapted to be secured to a middle portion of each frame section, and an inner board adapted to be secured to the two inner portions of the frame sections. A plurality of apertures 111 are formed on the elongated rods 2 for the countersunk bolts 122 to insert first through the apertures 121 then through the apertures 111 and fastened by nuts 123 from the opposite side of the apertures 111, as shown in FIG. 2. Each of the elongated rods 11 has a conjunction area at a free end of each inner portion which are secured together by inserting one end into the other end. This conjunction area enables the frame sections to be detached and to form two separate skateboards,as shown in FIGS. 3A and 3B. The skateboard 1 as shown in FIGS. 3A and 3B are able to perform more diffcult skating maneuvers, as shown in FIG. 4.

I claim:

1. A skateboard comprising a pair of frame sections, each frame section including a pair of elongated rods extending parallel to each other along inner and middle portions and diverging along an outer portion to form handgrips, the middle portion forming an obtuse angle with the inner portion of each frame section, means for releasably connecting free ends of the inner portions together to form a single frame assembly, each frame section having a wheel assembly secured to an outer end of the middle portion and a wheel assembly sectored to a junction point of the middle and inner portions, an outer board member secured to the middle portion of each frame section, an inner board member extending above each inner portion when their free ends are interconnected, and means for releasably connecting each of the inner portions to the inner board member.

* * * * *